US006779302B2

(12) United States Patent
Harrison et al.

(10) Patent No.: US 6,779,302 B2
(45) Date of Patent: Aug. 24, 2004

(54) DETECTION OF OBSTRUCTION OF DOORS

(75) Inventors: Nicholas Charles Harrison, Beverley (GB); Peter Edward James Spencer, Beverley (GB)

(73) Assignee: Deans Systems Limited, London (GB)

( * ) Notice: Subject to any disclaimer, the term of this patent is extended or adjusted under 35 U.S.C. 154(b) by 0 days.

(21) Appl. No.: 10/119,787

(22) Filed: Apr. 10, 2002

(65) Prior Publication Data

US 2003/0192252 A1 Oct. 16, 2003

(51) Int. Cl.[7] ..... E05F 15/02
(52) U.S. Cl. ..... 49/26; 73/760
(58) Field of Search ..... 49/26, 27, 28; 73/760, 785; 200/61.43

(56) References Cited

U.S. PATENT DOCUMENTS 3,727,348 A * 4/1973 Steinmann et al. ..... 49/28
4,773,183 A 9/1988 Okushima et al. ..... 49/28
4,908,483 A * 3/1990 Miller ..... 49/28
5,728,984 A * 3/1998 Miller ..... 49/28
6,427,382 B2 * 8/2002 Gregoriou et al. ..... 49/27

FOREIGN PATENT DOCUMENTS

DE 3444213 A1 6/1986
DE 4121916 A1 1/1993
EP 0 228 550 7/1987

* cited by examiner

*Primary Examiner*—Jerry Redman
(74) *Attorney, Agent, or Firm*—MacMillan, Sobanski & Todd, LLC

(57) ABSTRACT

Pneumatic sensing elements are provided on the leading edges of power operated vehicle doors. If an obstruction is encountered on closing the doors, the sensing elements are compressed to cause a pressure increase which is sensed and is used to open the doors. Each time the doors are opened, operation of the system is tested by applying a gas pressure pulse to the system. The pressure pulse is gradually vented through a fixed orifice. The pressure in the system produced by the pressure pulse is sensed and is applied to a controller which compares the pressure pulse information with information for known pulses for a normally operating system and for system failures caused, for example, either by a leak or by a blockage in the system.

11 Claims, 3 Drawing Sheets

DETECTION OF OBSTRUCTION OF DOORS

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

This invention relates generally to the detection of obstruction of power-operated doors when closing, so that if obstruction is detected the closing can be discontinued. More particularly the invention relates to the testing of the operational condition of such a system, with the object of ensuring that it functions satisfactorily when required.

BACKGROUND OF THE INVENTION

The invention has been devised in relation to doors for use on passenger carrying public service vehicles (buses and coaches) although it will be appreciated that it may be of broader application wherever power-operated doors are utilized e.g. in industrial applications. It is known to provide an edge of a power-operated door, which edge is the leading edge when the door is closing, with a means for detecting an obstruction if one is encountered in the course of closing of the door, for giving a signal so that closing of the door can be discontinued to prevent damage from occurring if attempted closing of the door against the obstruction is continued or injury if the obstruction is caused by a person. Such a system, a so called "sensitive edge" system using electrical sensors at the door edge is known and also it is known to have a pneumatically-operating sensitive edge system. In the latter, a sensing element comprising a flexible air chamber carried at the edge of the door is compressed if an obstruction is encountered causing a pressure rise in the interior of the chamber which can be detected and to which a control system can respond by discontinuing closing of the door. Since doors on transport vehicles commonly are pneumatically operated, the use of such a pneumatic sensitive edge system is convenient.

BRIEF SUMMARY OF THE INVENTION

However such a pneumatic sensitive edge system will not work if the air chamber provided along the edge of the door, or the connections thereto or associated therewith, become damaged. The present invention relates to the detection of any such damage which might cause the sensitive edge system to malfunction, and broadly it is the object of the present invention to provide an improved means for detecting such damage.

According to one aspect of the present invention, we provide a method of testing the integrity of a fluid-pressure-responsive sensing element for an obstruction-detection system, comprising applying to the interior of the sensing element a predetermined change in pressure; providing for relief of said changed pressure in a predetermined manner; and assessing a characteristic of the manner in which the pressure is actually relieved to provide, in comparison with said predetermined manner, an indication of said integrity.

Preferably said predetermined change in pressure is a pulse of increased pressure, applied by introducing a small quantity of fluid into the sensing element.

Preferably said relief of pressure in a predetermined manner is provided for by arranging for leakage of fluid from the sensing element by way of a small bleed orifice connecting the interior of the sensing element to external atmosphere, the size of the orifice being selected to provide a controlled rate of leakage of fluid from the sensing element.

Preferably the characteristic which is assessed is the rate at which pressure in the sensing element changes in response to the pressure pulse applied thereto, and this is most conveniently measured by timing the duration of the pressure pulse. Such timing may be effected by measuring the time elapsing between the pressure falling from a first value to a second value or rising and falling between said values.

If the sensing element is damaged and leaking, the pressure pulse applied thereto will diminish more rapidly than it would if the only source of leakage were the bleed orifice. If there were any blockage for example in a flexible pipe leading to a sensing element on the edge of a door, the result will be a pulse of longer duration than normal. Detection of a longer or shorter pulse than normal may then be used to cause a fault signal to be given. Whether the fault results from damage or obstruction in the sending element or pipes leading thereto, or a fault in the pulse generator itself, detection of the fault indicates the need for repair to be carried out.

Preferably testing of the sensing element as aforesaid is carried out each time a powered door provided with the sensing element is opened.

According to another aspect of the invention, we provide an obstruction detection system including a fluid-pressure-responsive sensing element and means for testing the integrity of said sensing element and associated parts of the system. The testing means comprises means for applying a predetermined change in pressure to the interior of the sensing element; means providing for relief of the changed pressure in a predetermined manner; and means for assessing the manner in which the pressure is actually relieved to provide, in comparison with the predetermined manner, an indication of said integrity. Preferably, the means for applying a predetermined change in pressure to the interior of the sensing element comprises means for creating a pressure pulse in said sensing element by introducing a predetermined quantity of fluid into the sensing element. A bleed orifice may provide for relief of excess pressure in the sensing element in the predetermined manner. In a preferred embodiment, the pressure pulse generating means comprises a piston movable within a cylinder, conveniently in response to the application of fluid pressure to the cylinder space on one side of the piston, with the cylinder space on the other side of the piston being connected to the sensing element. A one-way valve may be provided between the cylinder space on the other side of the piston and a connection leading to the sensing element.

As applied to a pneumatically operated door system, the obstruction detection system may be caused to operate each time the door is opened. The air pressure which causes the piston to be displaced to apply the pressure pulse may be caused to be applied by a control valve which causes the door to be opened, so that the pulse is provided each time the door is opened.

Preferably the characteristics of the pulse to indicate the integrity of the system are assessed by a pressure sensor providing an electrical output signal which is analyzed by a microprocessor-based data processor. It will be appreciated that in an obstruction detection system using a pneumatic sensing element, there is in any event provided a means for detecting when an obstruction is encountered by responding to the increase in system pressure caused thereby: in a system in accordance with the present invention the additional means for assessing the characteristics of the pressure pulse may be added to such a pressure sensor and data processing device. Preferably the characteristic which is assessed is the duration of the pressure pulse, as explained above and hereafter.

Various objects and advantages of the invention will become apparent from the following detailed description of the invention and the accompanying drawings.

DETAILED DESCRIPTION OF THE INVENTION

Figure 1:
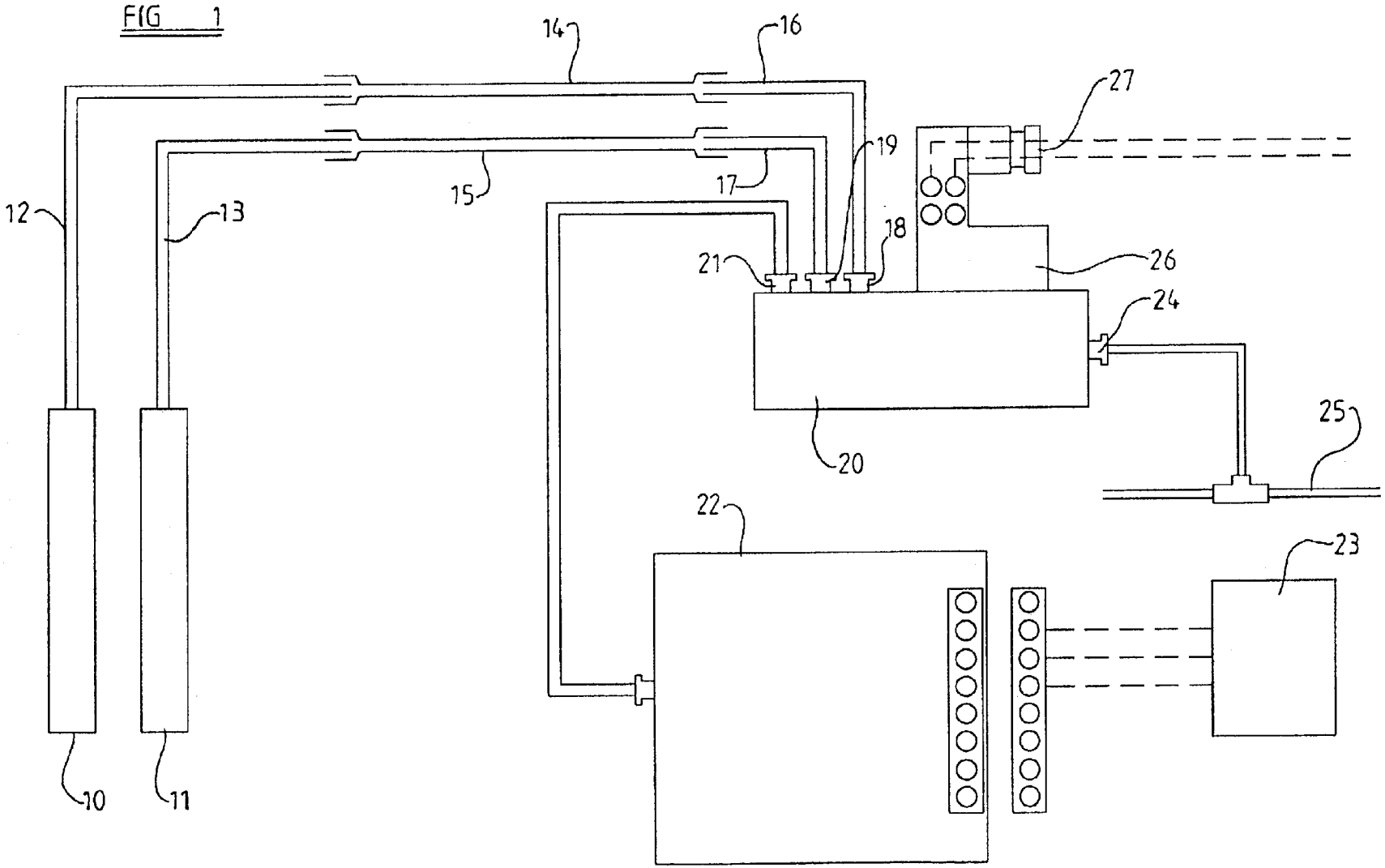
FIG. 1 is a diagrammatic illustration of an obstruction detection system which may be applied to a vehicle door in accordance with the invention.

Referring firstly to FIG. 1 of the drawings, a system according to the invention is shown as including two elongate pneumatic sensing elements 10, 11 which are provided along the edges of door parts which are the leading edges when the door parts are closing. The remaining portions of the door parts may be of various known design and are not shown. Typically the form of each such sensing element is an elongate rubber tube secured to the edge of the door part and arranged to be partially crushed if the door part encounters an obstruction in the course of closing. The sensing elements 10, 11 have gas filled interior spaces. Such tubes are closed at one end, and at their other end the interior spaces are connected to pipes 12, 13 which by way of flexible pipe sections 14, 15 and further rigid pipes 16, 17 extend to connections 18, 19 on a pulse generator 20 which is shown in greater detail in FIG. 2. A further connection 21 on the pulse generator leads to a pressure sensor 22 which provides an electrical output signal representing the pressure it senses. The electrical output signal from the pressure sensor 22 is applied to a microprocessor-based data processing means indicated generally at 23. The pulse generator 30 further has a connection 24 to an air supply pipe 25 for pneumatic operation of the doors. A solenoid valve 26 receives an electrical signal at 27 each time the doors are caused to be opened.

Figure 2:
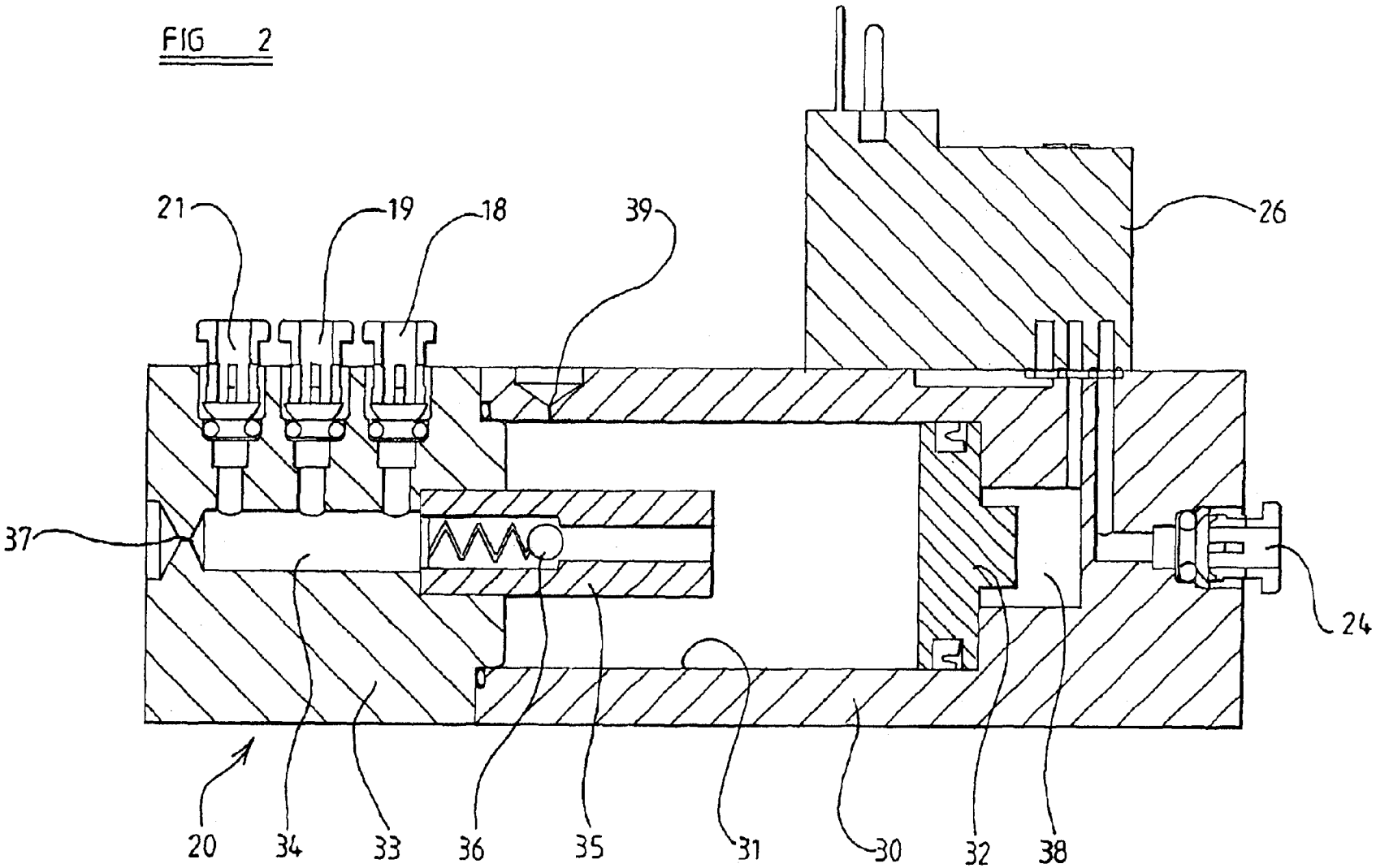
FIG. 2 is diagrammatic section through a pulse generator in accordance with the invention.

Referring to FIG. 2, the pulse generator 20 is shown in detail. The pulse generator 20 comprises a body 30 defining a cylinder 31 within which is disposed a piston 32. The piston 32 is displaceable lengthwise within the cylinder 31 and normally is spring biased to the right (with reference to the drawing) by a spring, not shown in the drawing, which reacts against a further body part 33 which closes the cylinder at its left end. The body part 33 has the connections 18, 19, 21 which communicate with a manifold space 34 in the body part. A valve body 35 contains a non-return valve 36 and extends into the cylinder space in the body 30 and provides a stop to limit movement of the piston 32 towards the body part 33. The body part 33 further is provided with a bleed orifice 37 which leads from the external atmosphere into the manifold space 34.

The solenoid valve 26, when an electrical signal is applied to it, causes air to be delivered from the supply connection 24 to a cylinder space 38 to the right of the piston 32 thus causing the piston 32 to be driven to the left until it abuts the valve body 35. The solenoid valve 26 is electrically energized each time the doors are opened. It will thus be appreciated that every time the door opening signal is applied to the solenoid valve 26, the effect is to drive the piston 32 to the left and apply air under pressure in a pulse through the valve 36 to the chamber or manifold space 34 and thence to the sensing elements 10, 11 by way of the pipes and connections 12 to 19. When the solenoid valve 26 is no longer electrically energized it allows venting to atmosphere of the cylinder space 38, and the piston 32 is spring-returned to its starting position as illustrated, while a bleed orifice 39 permits the cylinder space to the left of the piston 32 slowly to refill with air.

When the pressure pulse of air is applied to the manifold space 34 by displacement of the piston 32 as above described, it causes initially a pressure rise in the sensing elements 10, 11 and the pipes leading thereto, as well as the pipe leading to the pressure sensor 22. The pressure then decays by virtue of the bleed orifice 37. If however there is any leakage in the sensing elements or pipes, for example due to damage to a sensing element, the pressure therein will decay much more rapidly and will not reach such a high value. If on the other hand there is a blockage in, for example, the pipes leading to the sensing elements, the pressure therein will rise higher (as the volume of the system might, in effect, be reduced) and possibly decay more slowly. Therefore analysis of pressure changes detected by the sensor 22 as the pressure pulse is applied and decays gives an indication of any fault in the system.

Figure 3A:
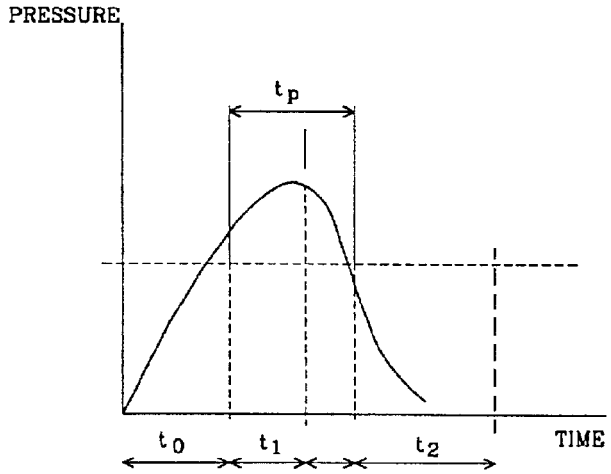
FIGS. 3*a*, 3*b* and 3*c* are graphs which illustrates operation of the system.
Figure 3B:
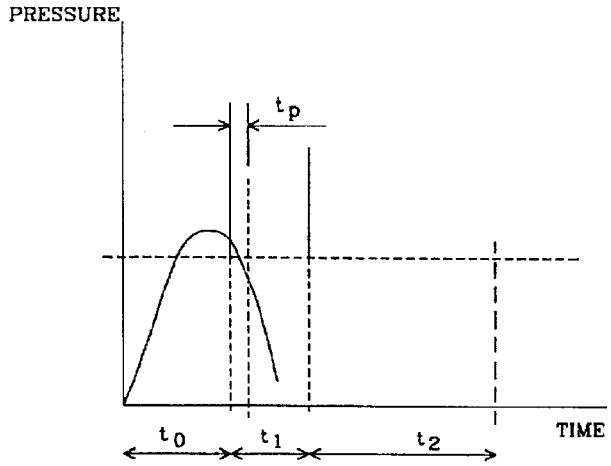
Figure 3C:
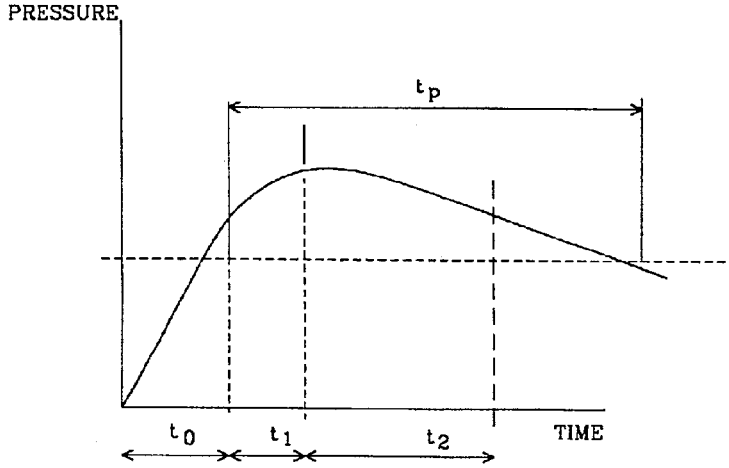

FIGS. 3*a*, 3*b* and 3*c* show diagrammatically the above conditions. Firstly, in FIG. 3*a*, there is shown a typical graph of pressure against time when the system is operating normally. FIG. 3*b* shows the shape of the pulse if the system is faulty due to a leak, while FIG. 3*c* shows the shape of pulse which might be obtained when the system is faulty due to a partial blockage in the pipes leading to one of the sensing elements. In FIG. 3*b*, it will be seen that the pressure rises to a lower value than in FIG. 3*a* and decays more rapidly, whilst in FIG. 3*c* the pressure rises to a higher value and decays more slowly.

The pulse may be analyzed by measuring the time $T_p$ between the pressure having a first value and a second lower value, after an initial time period $T_0$ from the door opening signal which causes the pulse generator to operate. An excessively short pulse indicates a system fault due to leakage, while an excessively long pulse indicates a system fault due to blockage. Such timing may be effected by the provision of suitable software in the microprocessor-based data processing system receiving the signal from the pressure sensor 22.

If the pulse as detected by the pressure sensor 22 does not commence within a certain time after the "door open" signal has been given, this is interpreted as a system fault. If the pulse timing and duration are satisfactory, the obstruction detection system is deemed to be healthy and the driver of a vehicle may close the doors by normal use of the door controls. If a fault is found, at least a warning may be given or possibly the driver may be prevented from operating the door by way of his door control.

In the present specification and claims "comprises" means "includes" or "consists of" and "comprising" means "including" or "consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof. It will be appreciated that various modifications and changes may be made to the above described preferred embodiment of without departing from the scope of the following claims.

What is claimed is:

1. An obstruction detection system for an edge of a movable door, comprising a sensing element defining an interior space containing a fluid, said sensing element being deformable to cause an increase in pressure in said fluid in said interior space when an obstruction is encountered, improvement comprising testing apparatus for testing the integrity of at least said sensing element and wherein said testing apparatus comprises:

a device introducing a predetermined quantity of said fluid into said interior space of the sensing element to raise the fluid pressure therein, said device further providing relief of the raised fluid pressure in said interior space of the sensing element over a predetermined time period; and assessment apparatus measuring a time period in which the raised pressure in the interior space of the sensing element is relieved following said introduction therein of the predetermined quantity of fluid, and comparing said measured time period with said predetermined time period to provide an indication of the integrity of at least the sensing element.

2. A system according to claim 1 wherein said device includes a bleed orifice for releasing the fluid from the sensing element, to relieve the raised fluid pressure in the interior space thereof over the predetermined time period.

3. A system according to claim 2 wherein said device comprises a cylinder having first and second ends and a piston movable therein to define a first cylinder space between the piston and the first end of the cylinder and a second cylinder space between the piston and the second end of the cylinder, the first cylinder space being connected to the interior space of the sensing element and the second cylinder space having fluid pressure applied therto to move the piston within the cylinder.

4. A system according to claim 3 and wherein said device further comprises a one-way valve in the connection between the first cylinder space and the sensing element.

5. An obstruction detection system according to claim 3 wherein said obstruction detection system is caused to be operated each time the door is opened.

6. A system according to claim 1 and further comprising a pressure sensor for measuring the fluid pressure in said interior space of the sensing element and providing an electrical output signal to said assessment apparatus.

7. An obstruction detection system according to claim 1 in combination with a vehicle.

8. An obstruction detection system according to claim 1 in combination with a door and the obstruction detection system is pneumatically operated.

9. In combination with a pneumatically operated vehicle door system including an obstruction detecting system comprising a flexible sensing element forming a leading edge of a vehicle door and having a gas filled interior space connected through pipes to a gas pressure sensor which generates a signal in response to pressure changes in said interior space caused by said sensing element being compressed by an obstruction when said vehicle door is closing, a testing system for said obstruction detecting system including a manifold chamber connected between said pipes and said pressure sensor, an orifice providing a controlled vent to said manifold chamber, means for applying an increased pressure gas pulse to said manifold chamber when said vehicle door is opened, and means responsive to said pressure sensor when a gas pulse is applied to said manifold chamber for detecting gas leaks and blockages in said obstruction detecting system.

10. A testing system for an obstruction detecting system for a pneumatically operated vehicle door system, as set forth in claim 9, and wherein said means for applying an increased pressure gas pulse includes a piston mounted to move in a cylinder, means for moving said piston in said cylinder to displace a volume of gas in response to said vehicle door being opened, and means delivering said displaced gas to said manifold chamber.

11. A testing system for an obstruction detecting system for a pneumatically operated vehicle door system, as set forth in claim 10, and wherein said means delivering said displaced gas to said manifold chamber comprises a check valve.

* * * * *